US007077342B2

(12) United States Patent
Lee

(10) Patent No.: US 7,077,342 B2
(45) Date of Patent: Jul. 18, 2006

(54) SHOWER HEAD ASSEMBLY

(75) Inventor: Chin-Tsai Lee, Chang Hua Hsien (TW)

(73) Assignee: Ching Shenger Co., Ltd., Hsien Hsi Hsiang (TW)

( * ) Notice: Subject to any disclaimer, the term of this patent is extended or adjusted under 35 U.S.C. 154(b) by 219 days.

(21) Appl. No.: 10/854,094

(22) Filed: May 25, 2004

(65) Prior Publication Data

US 2005/0263619 A1 Dec. 1, 2005

(51) Int. Cl.
*A62C 31/02* (2006.01)
*B05B 1/14* (2006.01)
*B05B 7/02* (2006.01)

(52) U.S. Cl. ..... 239/589; 239/590.5; 239/596; 239/526; 239/397; 239/390

(58) Field of Classification Search ..... 239/589, 239/590.5, 596, 597, 525, 526, 530, 390, 239/391, 397
See application file for complete search history.

(56) References Cited

U.S. PATENT DOCUMENTS

| | | | | |
|---|---|---|---|---|
| 4,303,201 | A * | 12/1981 | Elkins et al. | 239/381 |
| 4,588,130 | A * | 5/1986 | Trenary et al. | 239/381 |
| 5,398,872 | A * | 3/1995 | Joubran | 239/99 |
| 5,765,760 | A * | 6/1998 | Kuo | 239/440 |
| 6,116,524 | A * | 9/2000 | Zapalac | 239/548 |
| 6,739,527 | B1 * | 5/2004 | Chung | 239/558 |

* cited by examiner

*Primary Examiner*—Davis Hwu
(74) *Attorney, Agent, or Firm*—Alan D. Kamrath; Nikolai & Mersereau, P.A.

(57) ABSTRACT

A shower head assembly includes a main body, a water outlet panel, a mounting tube, a shade, and a locking nut. Thus, the mounting tube is indirectly combined with the water outlet pipe by the universal connector to form a pivotable shower head and is directly combined with the water outlet pipe to form a fixed shower head, thereby enhancing the versatility of the shower head assembly. In addition, the shower head assembly is provided with a shade having a variable shape to vary the pattern and profile of the shower head assembly, thereby enhancing the aesthetic quality and decreasing costs of the shower head assembly.

12 Claims, 9 Drawing Sheets

SHOWER HEAD ASSEMBLY

BACKGROUND OF THE INVENTION

1. Field of the Invention

The present invention relates to a shower head assembly, and more particularly to a shower head assembly provided with a shade having a variable shape.

2. Description of the Related Art

A conventional shower head assembly in accordance with the prior art shown in FIGS. 8 and 9 comprises a main body 11, a water outlet panel 12, a mounting tube 13, a universal connector 15, and a locking nut 16.

The main body 11 has a top formed with a mounting hole 111 and a bottom formed with a locking portion 112. The water outlet panel 12 is mounted on the bottom of the main body 11 and is formed with a plurality of water outlet holes 121. The water outlet panel 12 has a periphery formed with a locking portion 122 locked on the locking portion 112 of the main body 11. The mounting tube 13 is mounted in the mounting hole 111 of the main body 11. The mounting tube 13 has an outer wall formed with a protruding ring 131 and an outer thread 132. The protruding ring 131 of the mounting tube 13 is fixed on the top of the main body 11 by soldering. The mounting tube 13 has an inner wall formed with a recess 133, and a sealing ring 14 is mounted in the recess 133 of the mounting tube 13. The mounting tube 13 has a bottom formed with a closed face 134 and a plurality of water inlet holes 135 communicating with the inside of the main body 11. The universal connector 15 is pivotally mounted in the mounting tube 13. The locking nut 16 is formed with an inner thread 161 screwed onto the outer thread 132 of the mounting tube 13 and has a top formed with an urging flange 162 urged on the universal connector 15.

However, the conventional shower head assembly has a fixed structure that cannot be varied according to the practical requirement, thereby limiting the utility of the conventional shower head assembly. In addition, the conventional shower head assembly has to co-operate with the universal connector 15, thereby decreasing the versatility of the conventional shower head assembly.

SUMMARY OF THE INVENTION

In accordance with the present invention, there is provided a shower head assembly, comprising:

a main body having a top formed with a planar portion having a center formed with a mounting hole;

a mounting tube mounted in the mounting hole of the main body and having an outer wall formed with an outer thread;

a shade mounted on a periphery of the main body and having a top formed with an abutting portion rested on the planar portion of the main body; and a locking nut mounted on the mounting tube and urged on the shade, the locking nut having an inner wall formed with an inner thread screwed onto the outer thread of the mounting tube and having a bottom urged on the abutting portion of the shade, so that the shade is urged and clamped between the locking nut and the main body.

The primary objective of the present invention is to provide a shower head assembly, wherein the mounting tube is selectively combined with the universal connector to indirectly connect the water outlet pipe so as to form a pivotable shower head and is directly combined with the water outlet pipe so as to form a fixed shower head, thereby enhancing the versatility of the shower head assembly.

Another objective of the present invention is to provide a shower head assembly, wherein the shower head assembly is provided with a shade having a variable shape to vary the pattern and profile of the shower head assembly, thereby enhancing the aesthetic quality and decreasing costs of the shower head assembly.

Further benefits and advantages of the present invention will become apparent after a careful reading of the detailed description with appropriate reference to the accompanying drawings.

DETAILED DESCRIPTION OF THE INVENTION

Figure 1:
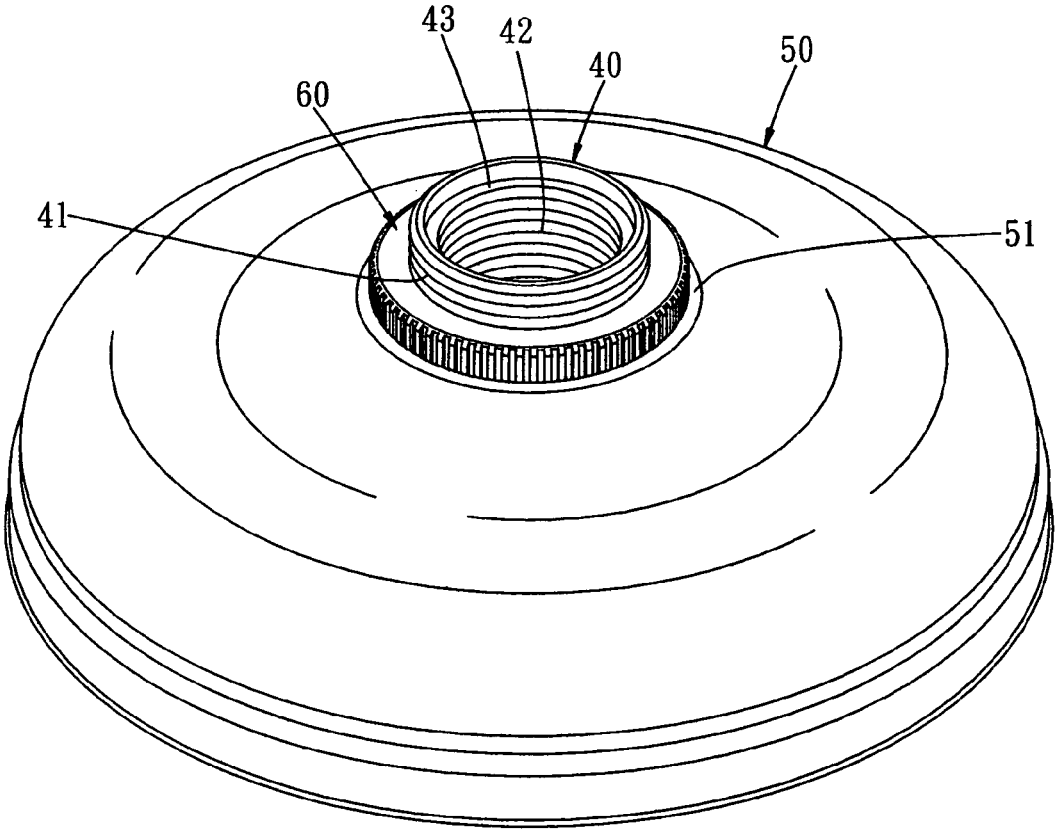
FIG. 1 is a perspective view of a shower head assembly in accordance with the preferred embodiment of the present invention.
Figure 2:
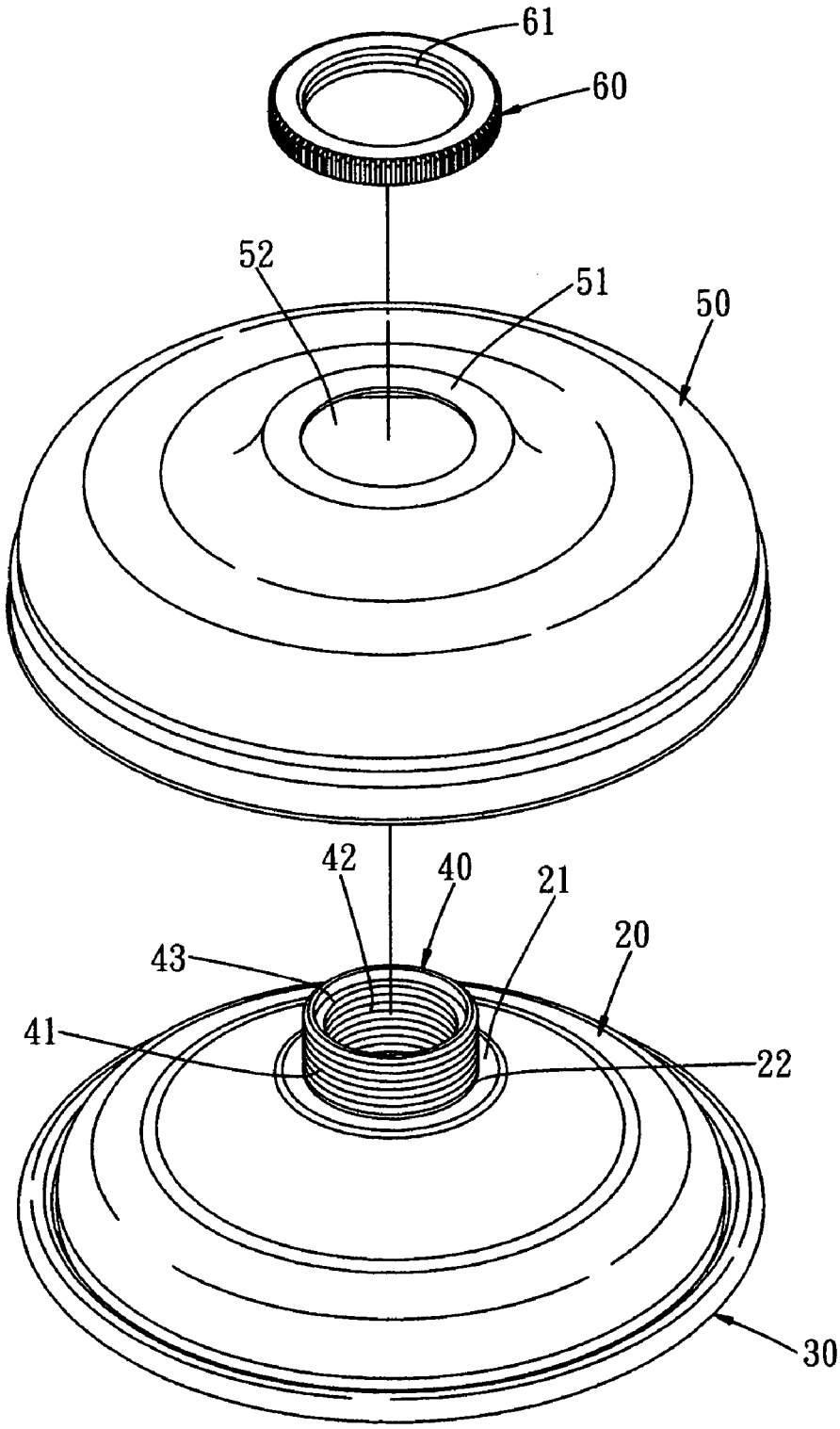
FIG. 2 is an exploded perspective view of the shower head assembly as shown in FIG. 1.
Figure 3:
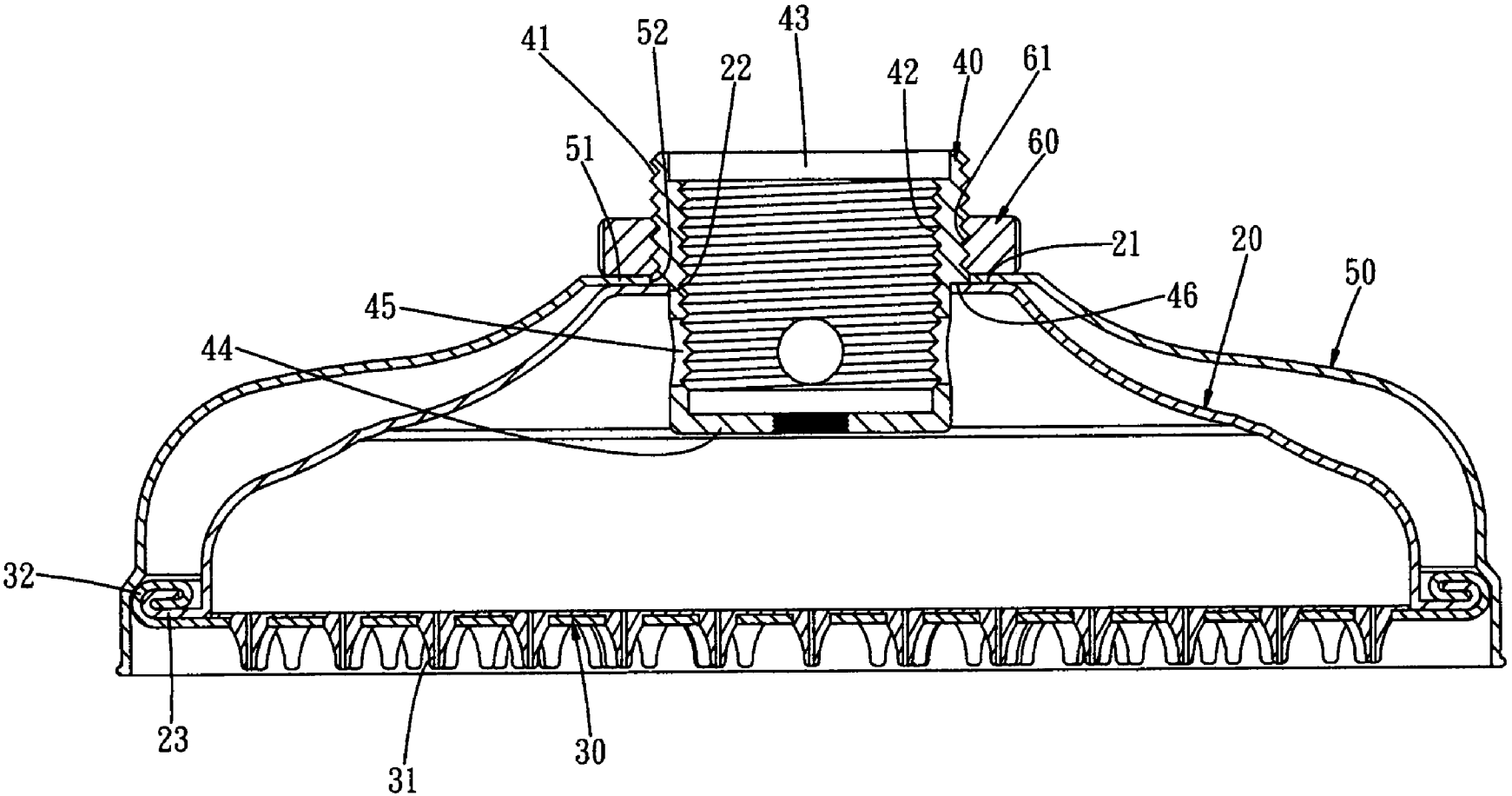
FIG. 3 is a plan cross-sectional view of the shower head assembly as shown in FIG. 1.

Referring to the drawings and initially to FIGS. 1–3, a shower head assembly in accordance with the preferred embodiment of the present invention comprises a main body 20, a water outlet panel 30, a mounting tube 40, a shade 50, and a locking nut 60.

The main body 20 has a top formed with a planar portion 21 having a center formed with a mounting hole 22 and a bottom formed with an outward extended locking portion 23.

The water outlet panel 30 is mounted on the bottom of the main body 20 and has a side formed with a plurality of water outlet holes 31. The water outlet panel 30 has a periphery formed with a locking portion 32 locked on the locking portion 23 of the main body 20.

The mounting tube 40 having a stepped shape is mounted in the mounting hole 22 of the main body 20. The mounting tube 40 has a stepped portion 46 fixed on the planar portion 21 of the main body 20 by soldering. The mounting tube 40 has an outer wall formed with an outer thread 41 and an inner wall formed with an inner thread 42 and a recess 43 located above the inner thread 42. The mounting tube 40 has a bottom formed with a closed face 44 and a plurality of water inlet holes 45 communicating with the inside of the main body 20.

The shade 50 is mounted on a periphery of the main body 20 and has a variable shape. The shade 50 has an inner diameter greater than an outer diameter of a combination of the main body 20 and the water outlet panel 30. The shade 50 has a top formed with a planar abutting portion 51 rested on the planar portion 21 of the main body 20. The abutting portion 51 of the shade 50 has a center formed with a mounting hole 52 mounted on the outer wall of the mounting tube 40. Preferably, the mounting hole 52 of the shade 50 has a diameter greater than an outer diameter of the mounting tube 40.

The locking nut 60 is mounted on the mounting tube 40 and urged on the shade 50. The locking nut 60 has an inner wall formed with an inner thread 61 screwed onto the outer thread 41 of the mounting tube 40 and has a bottom urged on the abutting portion 51 of the shade 50, so that the shade 50 is urged and clamped between the locking nut 60 and the main body 20 rigidly and stably.

Figure 4:
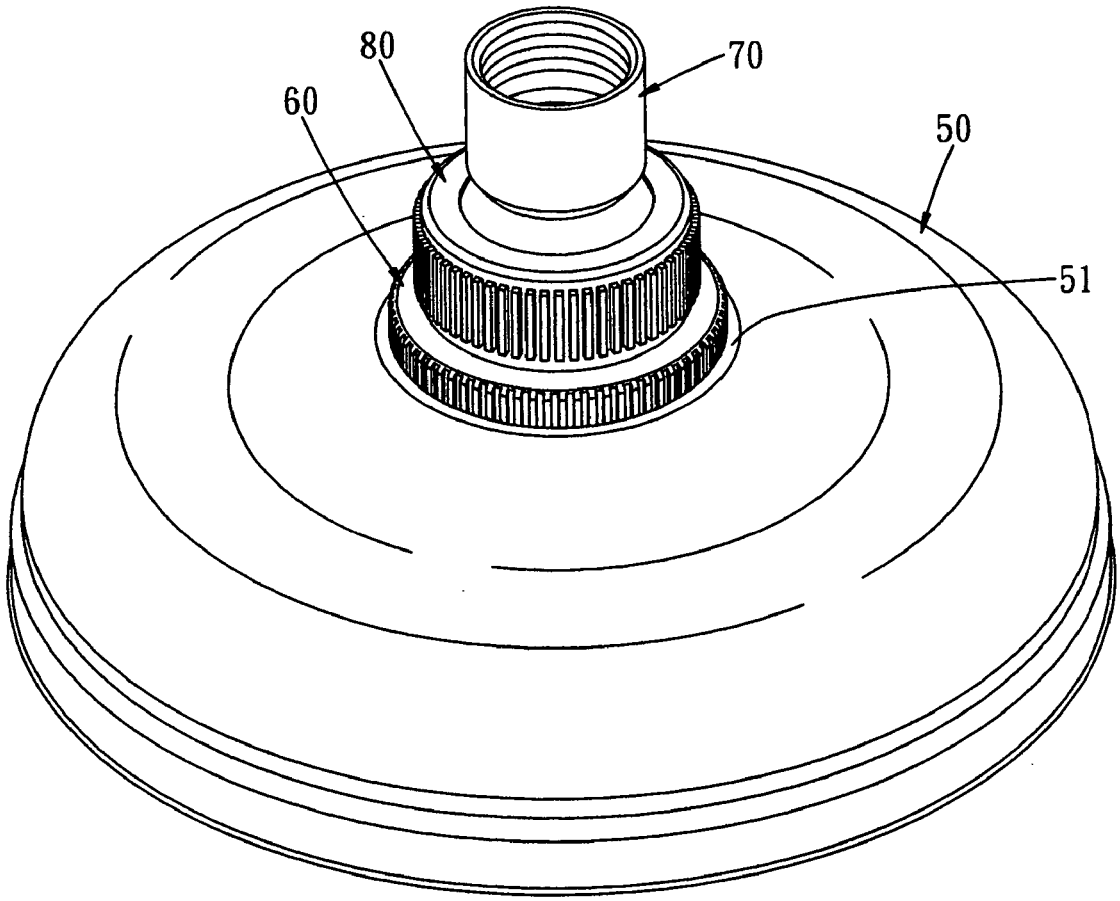
FIG. 4 is a perspective view of the shower head assembly in accordance with the preferred embodiment of the present invention.
Figure 5:
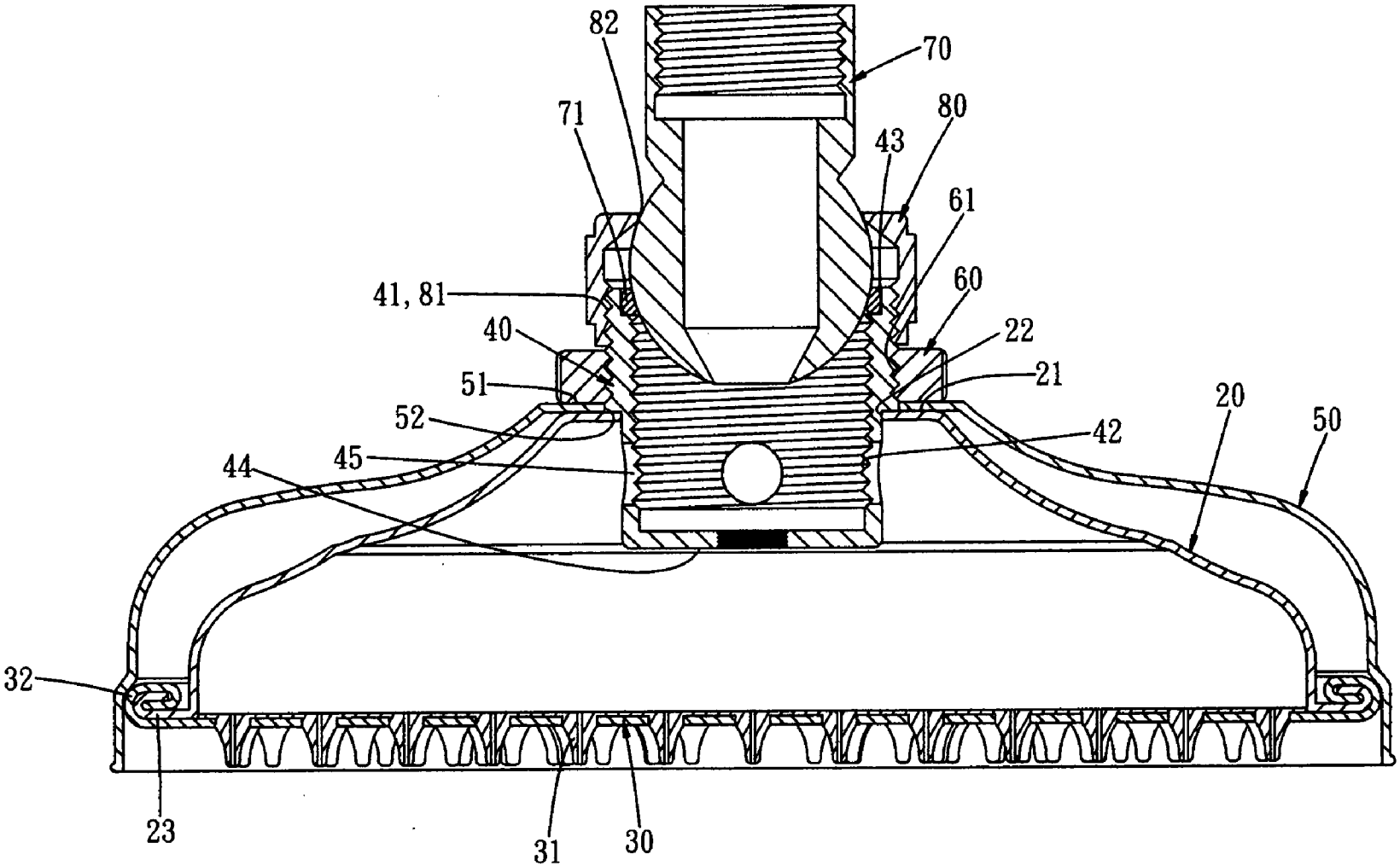
FIG. 5 is a plan cross-sectional view of the shower head assembly as shown in FIG. 4.

Referring to FIGS. 4 and 5, the shower head assembly further comprises a sealing ring 71 mounted in the recess 43 of the mounting tube 40, a universal connector 70 pivotally mounted in the mounting tube 40, and a positioning nut 80 having a bottom formed with an inner thread 81 screwed onto the outer thread 41 of the mounting tube 40 and a top formed with an urging flange 82 urged on the universal connector 70 to position the universal connector 70 on the mounting tube 40.

In practice, the universal connector 70 is screwed onto a water outlet pipe (not shown) mounted on a wall (not shown). Thus, the water from a faucet (not shown) in turn flows through the water outlet pipe, the universal connector 70, the inside of the mounting tube 40, the water inlet holes 45 of the mounting tube 40 and the inside of the main body 20 and flows outward from the water outlet holes 31 of the water outlet panel 30 for use.

Figure 6:
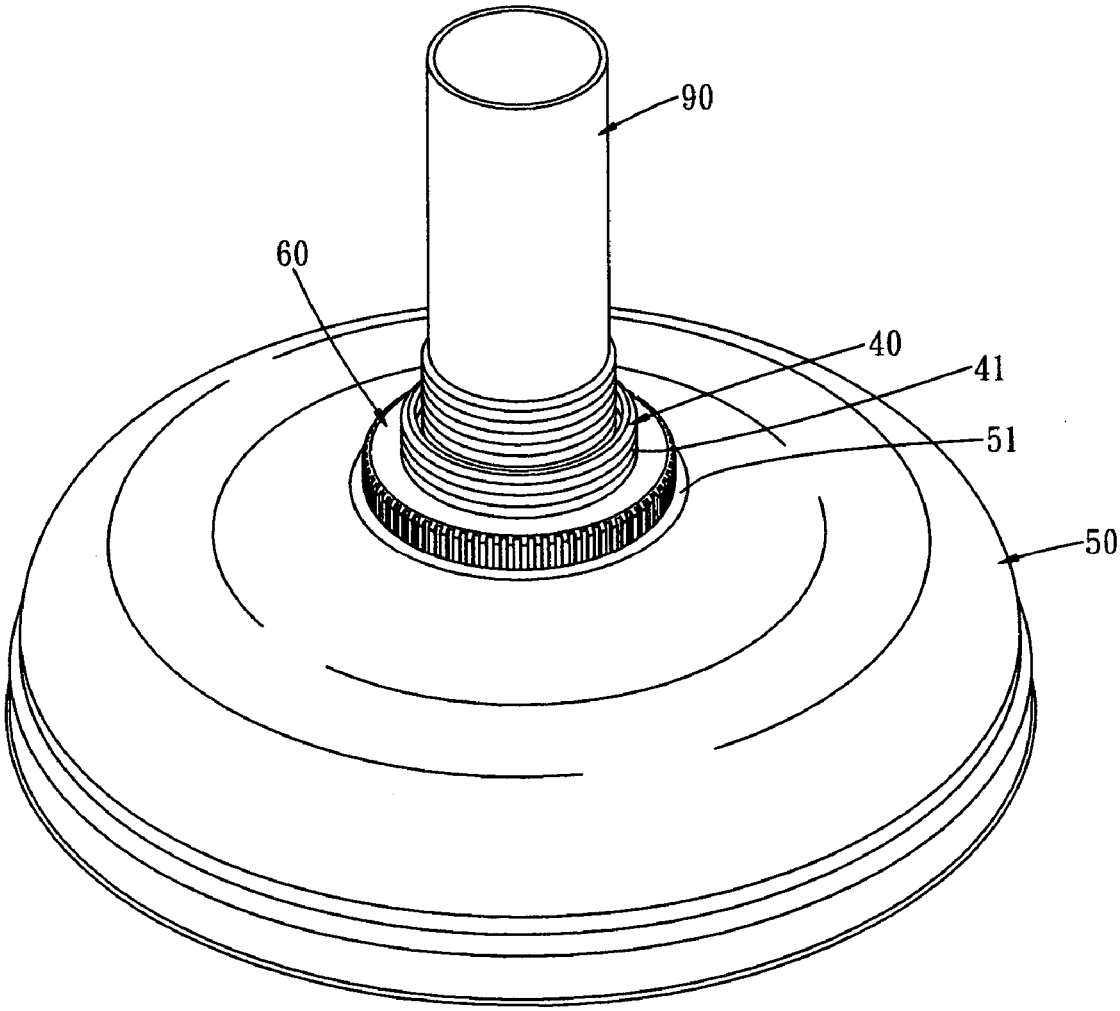
FIG. 6 is a perspective view of the shower head assembly in accordance with the preferred embodiment of the present invention.
Figure 7:
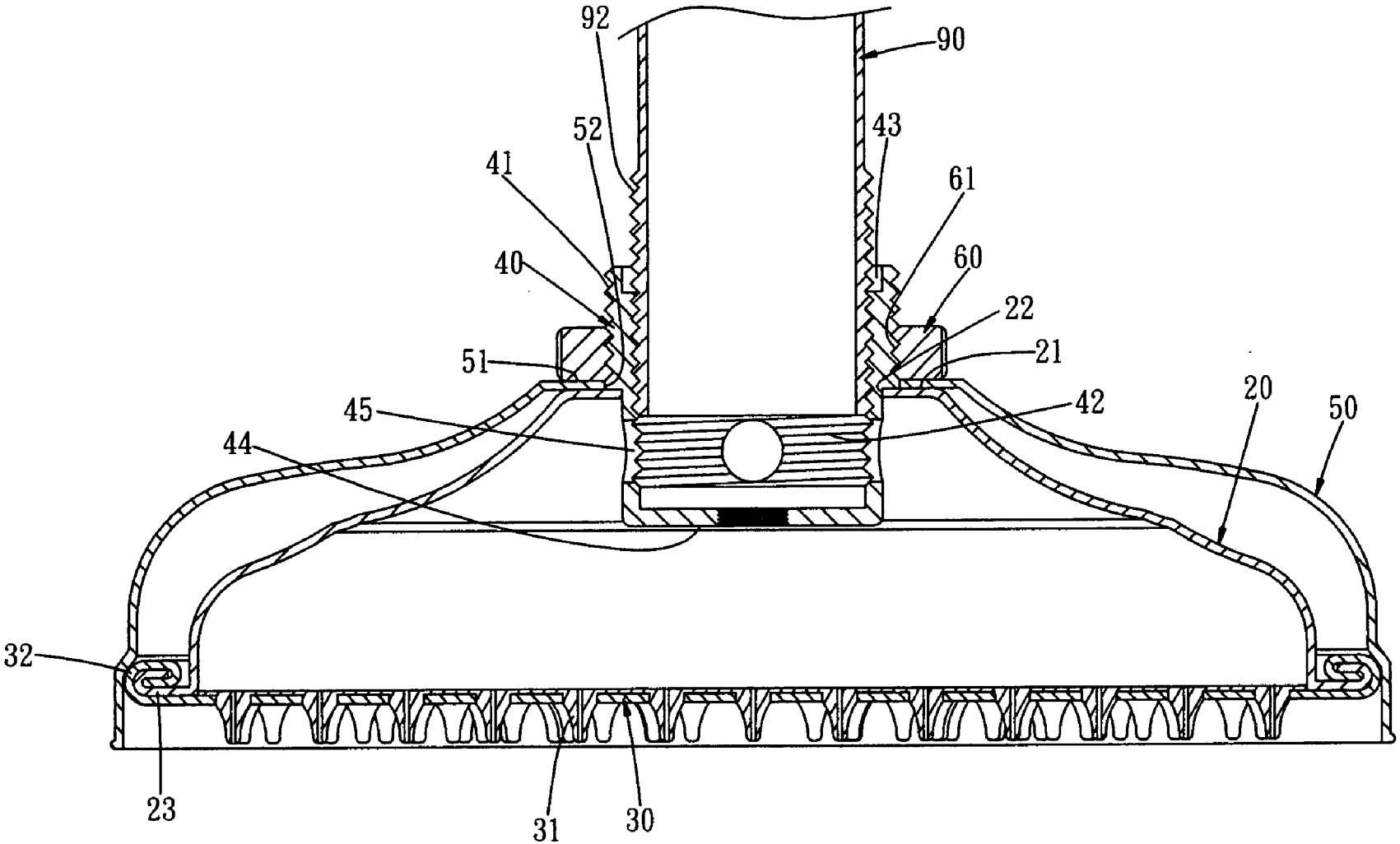
FIG. 7 is a plan cross-sectional view of the shower head assembly as shown in FIG. 6.
Figure 8:
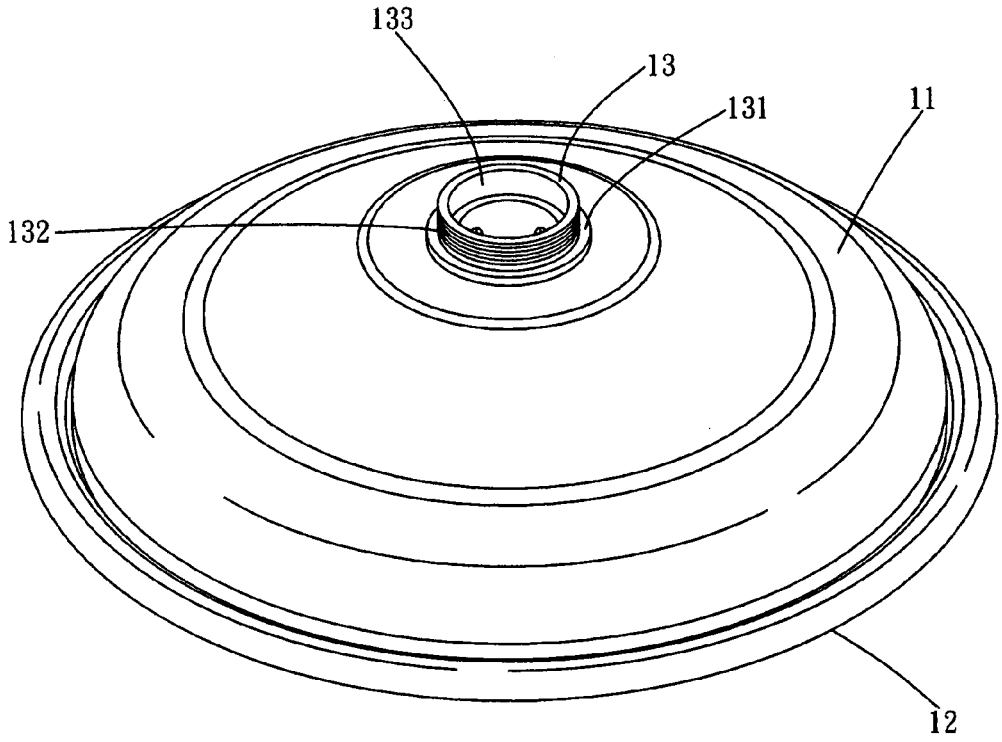
FIG. 8 PRIOR ART
FIG. 8 is a perspective view of a conventional shower head assembly in accordance with the prior art.
Figure 9:
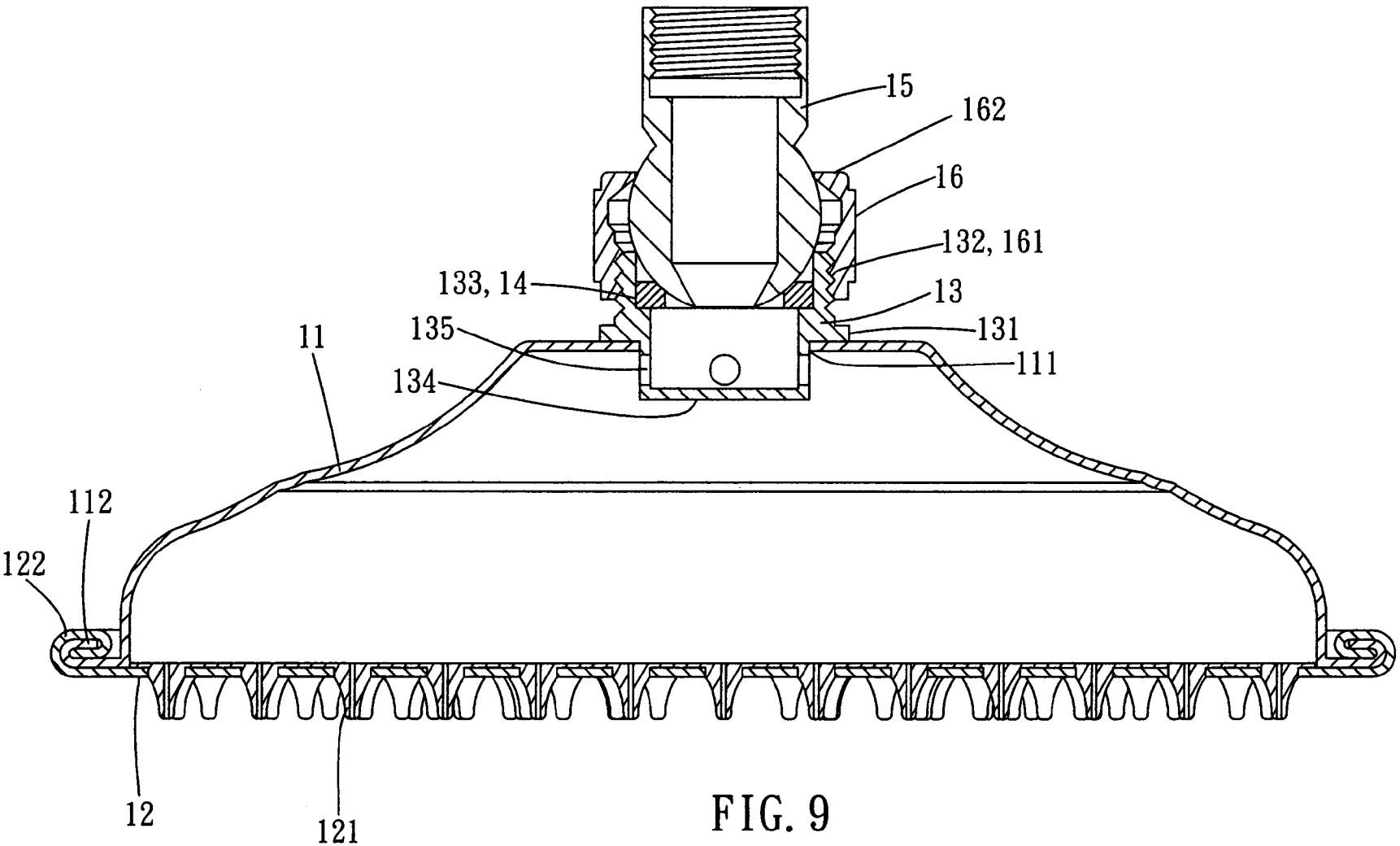
FIG. 9 PRIOR ART
FIG. 9 is a plan cross-sectional view of the conventional shower head assembly as shown in FIG. 8.

Referring to FIGS. 6 and 7, the inner thread 42 of the mounting tube 40 is directly screwed onto an outer thread 92 of a water outlet pipe 90 mounted on a wall (not shown). Thus, the water from a faucet (not shown) in turn flows through the water outlet pipe 90, the inside of the mounting tube 40, the water inlet holes 45 of the mounting tube 40 and the inside of the main body 20 and flows outward from the water outlet holes 31 of the water outlet panel 30 for use.

Accordingly, the mounting tube 40 of the shower head assembly is selectively combined with the universal connector 70 to indirectly connect the water outlet pipe 90 so as to form a pivotable shower head and is directly combined with the water outlet pipe 90 so as to form a fixed shower head, thereby enhancing the versatility of the shower head assembly. In addition, the shower head assembly is provided with a shade 50 having a variable shape to vary the pattern and profile of the shower head assembly, thereby enhancing the aesthetic quality and decreasing costs of the shower head assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head assembly, comprising:

a main body having a top formed with a planar portion having a center formed with a mounting hole;

a mounting tube mounted in the mounting hole of the main body and having an outer wall formed with an outer thread;

a shade mounted on a periphery of the main body and having a top formed with an abutting portion rested on the planar portion of the main body; and a locking nut mounted on the mounting tube and urged on the shade, the locking nut having an inner wall formed with an inner thread screwed onto the outer thread of the mounting tube and having a bottom urged on the abutting portion of the shade, so that the shade is urged and clamped between the locking nut and the main body.

2. The shower head assembly in accordance with claim 1, wherein the shade has a variable shape.

3. The shower head assembly in accordance with claim 1, wherein the shade has an inner diameter greater than an outer diameter of the main body.

4. The shower head assembly in accordance with claim 1, wherein the abutting portion of the shade has a center formed with a mounting hole mounted on the outer wall of the mounting tube.

5. The shower head assembly in accordance with claim 4, wherein the mounting hole of the shade has a diameter greater than an outer diameter of the mounting tube.

6. The shower head assembly in accordance with claim 1, wherein the mounting tube has a stepped shape.

7. The shower head assembly in accordance with claim 1, wherein the mounting tube has a stepped portion fixed on the planar portion of the main body.

8. The shower head assembly in accordance with claim 1, wherein the mounting tube has and an inner wall formed with an inner thread.

9. The shower head assembly in accordance with claim 8, wherein the inner wall of the mounting tube is formed with a recess located above the inner thread.

10. The shower head assembly in accordance with claim 9, further comprising a sealing ring mounted in the recess of the mounting tube, a universal connector pivotally mounted in the mounting tube, and a positioning nut having a bottom formed with an inner thread screwed onto the outer thread of the mounting tube and a top formed with an urging flange urged on the universal connector to position the universal connector on the mounting tube.

11. The shower head assembly in accordance with claim 8, wherein the inner thread of the mounting tube is directly screwed onto an outer thread of a water outlet pipe.

12. The shower head assembly in accordance with claim 1, wherein the abutting portion of the shade has a planar shape.

* * * * *